United States Patent [19]

Borst et al.

[11] 4,088,106

[45] May 9, 1978

[54] QUIESCENT CURRENT DISCONNECT SYSTEM AND APPARATUS FOR IGNITION COILS OF INTERNAL COMBUSTION ENGINE IGNITION SYSTEM

[75] Inventors: Wolfgang Borst; Karl Ott, both of Schwieberdingen, Germany

[73] Assignee: Robert Bosch GmbH, Stuttgart, Germany

[21] Appl. No.: 718,528

[22] Filed: Aug. 30, 1976

[30] Foreign Application Priority Data

Sep. 18, 1975 Germany ..... 2541594

[51] Int. Cl.[2] ..... F02P 9/00

[52] U.S. Cl. ..... 123/146.5 D; 123/148 E; 123/117 D

[58] Field of Search ..... 123/146.5 D, 117 D, 123/148 E, 117 R, 198 DC, 198 DB, 148 S

[56] References Cited

U.S. PATENT DOCUMENTS

| | | | |
|---|---|---|---|
| 3,745,985 | 7/1973 | Höhne | 123/148 E |
| 3,874,355 | 4/1975 | Suda et al. | 123/148 E |
| 3,921,610 | 11/1975 | Hartig | 123/148 E |
| 3,927,648 | 12/1975 | Kawai et al. | 123/117 D |
| 3,942,491 | 3/1976 | Seite et al. | 123/117 D |
| 4,018,197 | 4/1977 | Salway | 123/117 D |
| 4,018,202 | 4/1977 | Gartner | 123/148 E |

*Primary Examiner*—Charles J. Myhre
*Assistant Examiner*—R. A. Nelli
*Attorney, Agent, or Firm*—Flynn & Frishauf

[57] ABSTRACT

A speed related signal is counted out with respect to clock pulses having a predetermined rate in a counter; if, and when the counter reaches a certain predetermined number, the number is decoded and applied as a disconnect control signal to open a switch controlling current flow through the ignition coil. The number is selected to occur only if the engine operates at a very slow speed, or is stopped, so that no reset signal will be applied to the counter. A logic stage is provided having both the output of the count decoder stage as well as of the speed related signal applied thereto to ensure that disconnection is effected only when the counter has reached the decoding number, and then to continue reliably disconnection of the ignition current.

6 Claims, 4 Drawing Figures a.)

b.)

| A | B | Qn |
|---|---|---|
| 0 | 0 | Qn-1 |
| 0 | 1 | 0 |
| 1 | 0 | Qn-1 |
| 1 | 1 | 1 |

QUIESCENT CURRENT DISCONNECT SYSTEM AND APPARATUS FOR IGNITION COILS OF INTERNAL COMBUSTION ENGINE IGNITION SYSTEM

Cross reference to related patents and applications:

U.S. Pat. No. 3,898,972, HAUBNER

U.S. Pat. No. 3,923,021, STARK

U.S. Ser. No. 509,846, ACKERMANN et al. now U.S. Pat. No. 3,930,301, issued Dec. 30, 1975

U.S. Pat. No. 3,903,857, HONIG et al. now U.S. Pat. No. 3,949,252, issued Apr. 6, 1976

U.S. Ser. No. 557,014, RIESENBERG et al.

U.S. Pat. No. 3,874,351, ADLER et al.

U.S. Ser. No. 461,527, SCHOLL

U.S. Ser. No. 480,581, HAUBNER et al. now U.S. Pat. No. 3,951,122, issued Apr. 20, 1976

U.S. Ser. No. 491,047, LINSTEDT et al. now U.S. Pat. No. 3,949,722, issued Apr. 13, 1976

U.S. Ser. No. 587,627, WAHL now U.S. Pat. No. 4,015,566, issued Apr. 5, 1977

U.S. Ser. No. 650,971, GORILLE et al. Minimum issue fee Oct. 6, 1977

The present invention relates to a system and apparatus to disconnect current to the ignition system of an internal combustion engine having external ignition, in which the primary ignition current is interrupted if the speed of the engine drops below a predetermined level, or if the engine is stopped.

Internal combustion engines using ignition coils are so arranged electrically that if the engine is stopped, that is, if the crankshaft of the engine stopped and the ignition breaker contact should be closed, primary current will flow in the ignition coil if the main ignition switch is not disconnected. This current flow through the ignition coil is undesired since it heats the ignition coil and additionally loads the battery.

It has been proposed to provide an automatic disconnect arrangement in the primary circuit of ignition coils in which a thermostat is provided through which the primary current flows, the thermostat being heated by the primary current and when the heating due to the primary current reaches a predetermined level, a switch is energized which interrupts current flow. Such devices are not reliable since an internal combustion engine which rotates very slowly may have an average primary current flow therethrough in which the difference between average operating current and quiescent current is small, so that external temperature conditions can influence the disconnect feature of the thermostat. The additional mechanical contact within the ignition system further interferes with operating reliability of the entire ignition system.

It is an object of the present invention to provide a system and an apparatus to disconnect quiescent current through the ignition coil of an internal combustion engine, which is independent of current flow through the ignition coil itself and which is reliable and requires only few constructional elements which, preferably, should be small and themselves resistant to malfunction or interference.

SUBJECT MATTER OF THE PRESENT INVENTION

Briefly, speed or engine rotation signals, which are frequently available in modern vehicles and other internal combustion engine systems, are used to provide control signals for interruption of the primary current to the ignition coil. The speed or rotation signals are counted with pulses at a predetermined frequency, and control signals are derived depending on the count state of the counter.

The system, and apparatus permit selection of the quiescent current disconnect point depending on the counter state. This is particularly desirable since the same apparatus may be used for different types of internal combustion engines having different idling speeds, by merely setting the disconnect number of the counter to an appropriate value matched to a particular engine. By digital counting of speed or rotation signals, maximum noise and interference rejection with respect to stray pulses is provided.

The apparatus, in accordance with the invention, includes a counter preferably with a count state decoding stage connected thereto, as well as a logic circuit which, together, form a control system. The logic circuit is connected to a speed or rotation transducer and the counter state decoding stage, the output of which is connected to a switch operating as a disconnect switch for the primary count of the ignition coil.

The output signal of the rotation or speed transducer is used to process pulses, depending on the output signal, in such a manner that the apparatus to disconnect quiescent current will operate without malfunction. This requires steep flanks of the signal derived from the speed or rotation transducer.

The logic circuit, preferably, includes at least one switching stage which is controlled by a pulse derived from a flank of a square wave signal, and is further controlled by the output signals of the counter decoding stage.

Speed data or crankshaft angle data can be obtained by a star-wheel transducer. If this transducing arrangement is selected, then it will not matter whether the counting is related to pulse duration, pulse gaps or pulse periods. Customarily, star-wheel transducers resolve crankshaft angle for three degrees of crankshaft rotation. This suffices, and each three degrees of crankshaft rotation can be counted for control of a quiescent current disconnect system for the ignition current.

The invention will be described by way of example with reference to the accompanying drawings, wherein.

Figure 1:
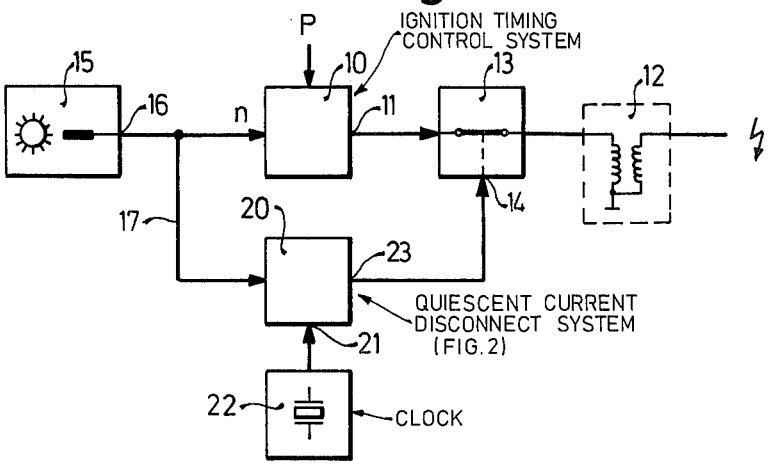
FIG. 1 is a general block circuit diagram of an ignition system with quiescent current disconnect.

The ignition system of FIG. 1, basically, is known and used the speed parameter *n* and pressure parameter *p* of the engine as control parameters to adjust the ignition instant of ignition timing. The output 11 of the control system 10 is connected to the primary of an ignition coil 12, the secondary is connected to a spark plug, as shown schematically be the electrical lightning symbol. A switch 13 is interposed between the output of circuit 11 and ignition coil 12. The switch 13 is controlled switch and has a control input 14. Speed information for the ignition system 10 is provided by a speed transducer 15. The output 16 of speed transducer 15 is connected through line 17 to a control stage 20 for quiescent current disconnect. A source of constant clock frequency from a clock frequency generator 22 is connected to the system 20 in order to count the pulses from transducer 15 and relate them to a fixed time base. The output 23 of the control system 20 is connected to the control input 14 of the switch 13.

The ignition system 10 operates independently of the quiescent current disconnect and provides the desired ignition pulses. This ignition system may be constructed, for example, as described in the cross-referenced patents and applications. The processing of the signals in the quiescent current disconnect system are in parallel thereto. The output signal of the system 20 does not act on the ignition system as such, but only interrupts connection of the supply line between the ignition system 10 and the ignition coil 12. It is also possible, of course, to connect the output 23 of the system 20 to the ignition timing control system 10 by logical connection thereto or, inherently, to logically connect the ignition system as will be described below.

Figure 2:
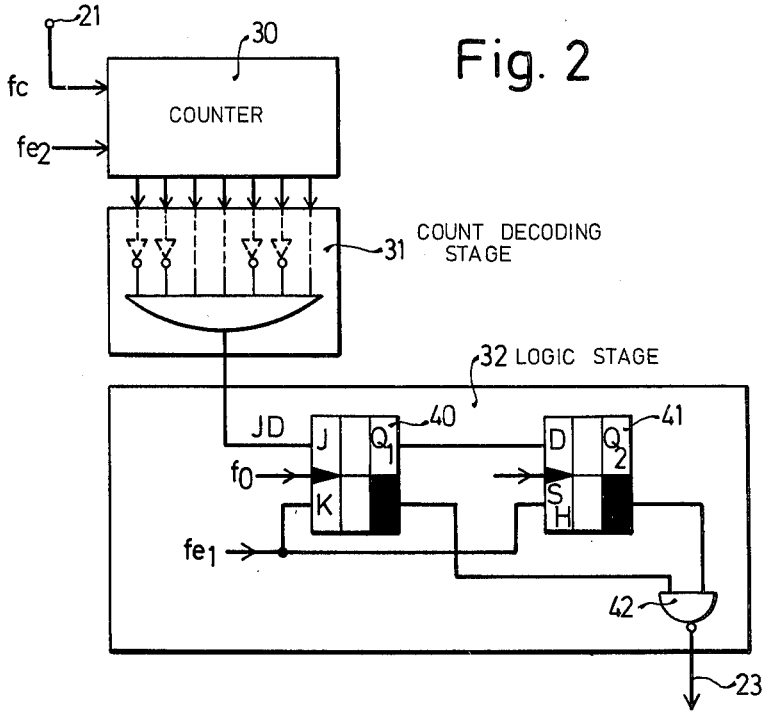
FIG. 2 is a detailed block diagram, in schematic form, of the essential portion of the disconnect circuit.

Control stage 20 is shown in FIG. 2 in simplified form. Basically, it includes a counter 30,a counter decoding stage 31 and a logic stage 32.

Figure 3:
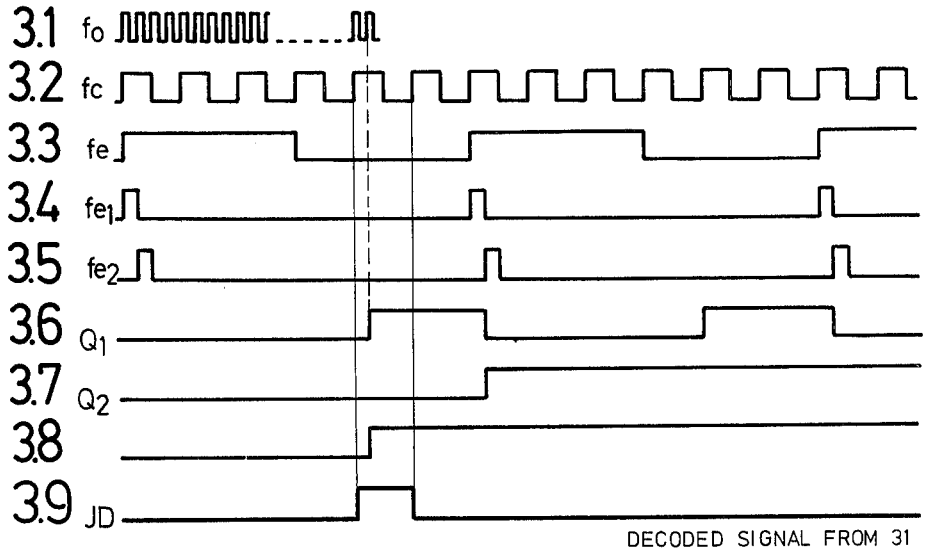
FIG. 3 is a pulse diagram illustrating the operation of the system of FIG. 2.

The system of FIG. 2 as well at its operation are best understood by reference to FIG. 3. Graph 3.1 of FIG. 3 illustrates a clock frequency $f_o$. Graph 3.2 shows the counting frequency $f_c$ for counter 30. The graph 3.3 illustrates the signal from transducer 15, as converted into square waves by a suitable wave-shaping circuit incorporated in or connected to the transducer 15 in advance of its connection to line 17. The signals $f_e$1 and $f_e$2, shown in graphs 3.4 and 3.5, are derived from the speed signal of graph 3.3. The signal $f_e$1 characterizes the position of the rising flank of the speed signal, and can be derived, for example, by a differentiator, as well known. The signal $f_e$2 of graph 3.5 is shifted with respect to the signal of graph 3.4 by one clock period. The shift of the two signals with respect to each other can be obtained readily by a time-shifting network, for example a D-flip-flop. This phase shift in necessary to permit carrying out logical operations with the signal $f_e$1 before the counter 30 is reset by the signal of graph 3.5, $f_e$2.

The logic stage 32 includes a J-K-flip-flop (FF) 40, as well as an S-H FF 41. The inverting outputs of the two FF's 40, 41 are connected over respective output lines to a NAND-gate 42, the output of which forms the output 23 of circuit 20. Signal $f_e$1 is applied both to the K input of the J-K FF 40, as well as to the S/H input of the S-H FF 41. The output of the counter decoding stage 31 is connected to the J-input of the J-K FF 40, the direct output of $Q_1$ being connected to the D-input of the S-H FF 41.

Graph 3.6 of FIG. 3 illustrates the $Q_1$ output, that is, the direct output of the J-K FF 40. Graph 3.7 illustrates the $Q_2$ output of the S-H FF 41. The disconnect signal, graph 3.8, is derived by the NAND association by the NAND-gate 42 of the two signals $Q_1$ and $Q_2$.

Figure 4:
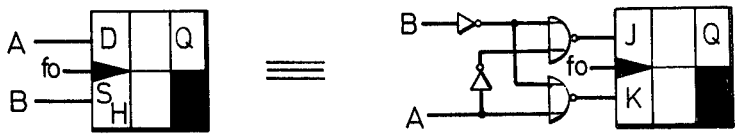
FIG. 4, view *a*, is a simplified diagram of an S-H flip-flop, using a J-K flip-flop element, and view *b* shows the truth table for the structure of view *a*.

FIG. 4 illustrates the construction of the S-H FF, as shown in FIG. 2, in greater detail. The function can readily be obtained by a J-K FF with logic gates connected to the respective A and B inputs, as shown in FIG. 4.

The truth table resulting from the connection of the S-H FF is illustrated in FIG. 4*b*. As can be seen, if a logic 1-signal is applied to both inputs, a logic 1 will be derived at the next clock pulse at the direct output. For all other cases of variables connected to the inputs, either the previous output signal is maintained or it is reset. If the SH input has a logic 1 applied thereto, the next clock pulse frequency will store the logic 1 signal applied to the D input and hold it available at the Q output.

Operation: Initially, upon the beginning of any period of the speed signal, counter 30 will start a count sequence at a fixed frequency as controlled by input 21, signal $f_c$, graph 3.2. When the count state reaches a predetermined value, which can be set in the count decoding stage 31 (Graph 3.9), an output signal is derived therefrom and applied to the J-K FF 40, which will be SET at the next clock pulse $f_o$, that is, at base frequency, and provide an output signal from terminal $Q_1$ as seen in graph 3.6. Since FF's operate under control of the flanks of signals, the transfer of the signal to SET the FF 40 is reliable and will occur under all conditions. The only requirement is that the pulse widths of the pulses $f_e$1 and $f_e$2 are wider than the basic clock rate of $f_o$, graph 3.1. The pulses $f_e$1 and $f_e$2 are best generated by synchronization with the base clock frequency $f_o$. If the pulses $f_e$1 and $f_e$2 are generated by a differentiator circuit, then this condition must be observed. The output from terminal $Q_1$ of FF 40 is transferred to the output $Q_2$ of the S-H FF 41 upon the subsequent $f_e$2 output. The system output 23, due to the logic interconnection of the FF output signals in the NAND-gate 42, will likewise be a logic 1 when the J-K FF 40 changes over. This logic 1 at the output 23 is maintained due to the inherent operation of the S-H FF 41 for that period of time during which the input of the FF 41 has a logic 1 applied thereto during the $f_e$1 signal. Upon occurence of the next $f_e$1, the switching state of the logic is tested and if the situation was as before, it will continue. Thus, the output signal of the disconnect system 20 is tested upon the recurrence of each speed signal. This results in high sensitivity and reliability of the quiescent current disconnect system.

Various changes and modifications may be made within the scope of the inventive concept.

We claim:

1. Ignition coil quiescent current disconnect system to interrupt current flow through the ignition coil (12) of the ignition system of an internal combustion engine by opening a switch (13) controlling current flow to the ignition coil, comprising
- means (15, 16) generating a speed-control signal ($f_e$);
- means (22) generating a clock signal ($f_o$, $f_c$);
- and a disconnect control stage (20) including
  - a counter (30) connected to the speed-related signal ($f_e$) and the clock signal ($f_c$) counting out the speed related signal at the clock rate and providing a count signal
  - and a logic stage (32) having the count signal from the output of the count decoding stage (31) as well as the speed related signal ($f_e$) applied thereto and providing a disconnect signal upon logical combination of the speed related and the count signals.

2. System according to claim 1 further including a count decoding stage (31) connected to the output of the counter (30) and determining when the count state of the counter has reached said predetermined number.

3. System according to claim 2 wherein the logic stage (32) includes a bistable element.

4. System according to claim 2, wherein the logic stage comprises
- at least one bistable switch means (40), the state of which is controlled by the count output signal from the decoding stage (31) connected to the counter (30) and by a flank ($f_e$1) of the speed signal ($f_e$).

5. System according to claim 4, wherein the bistable switch means comprises two bistable switch elements (40, 41), one of which forming a J-flip-flop (FF) and the second bistable element having the switching characteristics of an S-H flip-flop (41), said switches (40, 41) being sequentially connected.

6. System according to claim 1 wherein the logic stage (32) includes a bistable element.

* * * * *